US005584986A

United States Patent [19]

Bartholic

[11] Patent Number: 5,584,986

[45] Date of Patent: Dec. 17, 1996

[54] FLUIDIZED PROCESS FOR IMPROVED STRIPPING AND/OR COOLING OF PARTICULATE SPENT SOLIDS, AND REDUCTION OF SULFUR OXIDE EMISSIONS

[75] Inventor: David B. Bartholic, Watchung, N.J.

[73] Assignee: Bar-Co Processes Joint Venture, Houston, Tex.

[21] Appl. No.: 304,834

[22] Filed: Sep. 13, 1994

Related U.S. Application Data

[63] Continuation-in-part of Ser. No. 34,809, Mar. 19, 1993, abandoned.

[51] Int. Cl.[6] ..... C10G 11/00; C10G 35/10

[52] U.S. Cl. ..... 208/151; 208/150; 208/164; 208/159; 208/120; 208/113

[58] Field of Search ..... 208/151, 150, 208/164, 159, 120, 113

[56] References Cited

U.S. PATENT DOCUMENTS

| | | | |
|---|---|---|---|
| 3,893,812 | 7/1975 | Conner et al. | 208/164 |
| 3,926,778 | 12/1975 | Owen et al. | 208/151 |
| 4,263,128 | 4/1981 | Bartholic | 208/91 |
| 4,424,116 | 1/1984 | Hettinger, Jr. | 208/151 |
| 4,738,829 | 4/1988 | Krug | 208/151 |
| 4,793,915 | 12/1988 | Haddad et al. | 208/153 |
| 4,859,315 | 8/1989 | Bartholic | 208/153 |
| 4,917,790 | 4/1990 | Owen | 208/151 |
| 4,921,596 | 5/1990 | Chou et al. | 208/113 |
| 4,985,136 | 1/1991 | Bartholic | 208/153 |
| 5,059,305 | 10/1991 | Sapre | 208/151 |
| 5,139,649 | 8/1992 | Owen et al. | 208/151 |
| 5,332,704 | 7/1994 | Bartholic . | |

FOREIGN PATENT DOCUMENTS

| | | |
|---|---|---|
| 0184517A1 | 6/1986 | European Pat. Off. . |
| 0187032A1 | 7/1986 | European Pat. Off. . |
| 0309244A1 | 3/1989 | European Pat. Off. . |

OTHER PUBLICATIONS

European Search Report, Application No. 94301955.4, dated Jun. 30, 1994.

*Primary Examiner*—Helane Myers
*Attorney, Agent, or Firm*—Finnegan, Henderson, Farabow, Garrett & Dunner, L.L.P.

[57] ABSTRACT

A fluidized process which comprises contacting a hydrocarbon feedstock with a fluidized particulate solid in a contacting zone wherein carbonaceous deposits accumulate on the solid and the solid becomes spent and wherein the carbonaceous deposits are burned from the spent solid to produce a regenerated solid; removing a stream of the fluidized spent solid and entrained hydrocarbons from the contacting zone; introducing the fluidized spent solid/entrained hydrocarbon stream and a stream of hot regenerated solid into a lower portion of a zone; introducing a stream of a fluid stripping medium, e.g, water and/or steam into the lower portion of the stripping zone to contact the spent solid therein; passing a stream of the spent solid mixed with the stripping medium and the hot regenerated solid upwardly in the stripping zone to an upper portion thereof under dilute phase stripping conditions; separating the spent solid from the hydrocarbons and stripping medium in a separation zone connected to the upper portion of the stripping zone; passing a fluidized stream of separated solid from the separation zone to the regeneration zone wherein said carbonaceous deposits are burned therefrom to produce a regenerated solid for return to the reaction zone; removing a stream containing vaporized separated hydrocarbons and stripping medium from the separation zone; separating the vaporized separated stripping medium from the hydrocarbons; recycling the separated stripping medium to the stripping zone. The process also contemplates introducing the medium into a lower portion of a dilute phase zone to cool the solid.

23 Claims, 1 Drawing Sheet

FLUIDIZED PROCESS FOR IMPROVED STRIPPING AND/OR COOLING OF PARTICULATE SPENT SOLIDS, AND REDUCTION OF SULFUR OXIDE EMISSIONS

This application is a continuation-in-part of application Ser. No. 08/034,809, filed Mar. 19, 1993.

FIELD OF THE INVENTION

This invention relates to the processing of hydrocarbons wherein a hydrocarbon feedstock is contacted with a fluidized particulate solid which accumulates carbonaceous deposits thereon to form spent solid, and the spent solid is circulated to a regeneration zone wherein the carbonaceous deposits are burned. More particularly, this invention relates to a method for reducing the amount of hydrocarbons entrained with the spent solid circulated to the regeneration zone and for enhancing the operation of the regeneration zone while also reducing the emission of sulfur oxides from the regeneration zone.

BACKGROUND OF THE INVENTION

Since the fluidized catalytic cracking (FCC) process was first introduced in the 1940s, the FCC process spent catalyst has been stripped with steam in a stripping section that is part of the reactor vessel. The purpose of the spent catalyst stripper is to strip out the hydrocarbon vapors entrained with the spent catalyst from the reactor section of the FCC process with steam. Typically, the steam enters the dense phase stripping section of the reactor at the bottom of the stripper, but in some of the newer stripper designs steam is introduced at two elevations in the stripping section of the reactor vessel and is referred to as two-stage stripping. In some designs, spent catalyst from the dense phase stripper has been transferred to a vertical riser and lifted with a lift gas to a secondary stripper before being sent to the FCC regenerator. In all such processes the stripper operates as a dense bed stripper with an average bed density across the stripper of 25 to 35 pounds per cubic foot. In the typical spent catalyst stripping section of modern FCC systems, the steam is introduced into the dense bed stripper at a rate of about 1 to 2 pounds of steam per 1,000 pounds of catalyst circulated. This rate of stripping steam results in a volume of steam vapor that is about equal to the interstitial volume of hydrocarbon vapors between the catalyst particles. Therefore, the rate of stripping steam normally in use in FCC units acts as a displacement media for the hydrocarbon vapors and not as a true stripping media (i.e., there is no upward velocity of steam).

This lack of adequate stripping is consistent with the observation that the accepted weight percent hydrogen in coke numbers for a typical FCC systems is 7 weight % at about a 7 to 1 catalyst to oil ratio, while the observed weight percent hydrogen in coke for a fluidized solids process operating at a 4 to 1 catalyst to oil ratio is only about 3.5 weight % and the observed weight percent hydrogen in coke in the ultra-short contact time catalytic cracking process (as hereinafter referred to) operating at 22.6 to 1 catalyst to oil ratio can be as high as about 21 weight %. An analysis of this data indicates that in the typical stripper design with 1 to 2 pounds of stripping steam per 1,000 pounds of catalyst circulation the stripper efficiency is very poor. These data and observations indicate that, depending on the operation, about 20 to 50% of the total coke burned in the regenerator is from hydrocarbon vapors entrained into the regenerator with the circulating catalyst. In fact, one can make the argument that the entrainment rate of hydrocarbon vapors with the spent catalyst circulated into the regenerator is very similar to the rate of "inerts" (products such as CO, $CO_2$, $H_2$, $H_2O$, $SO_x$ and the like resulting from the combustion of coke on spent catalyst) entrained with the regenerated catalyst into the reactor system, or about 1 to 2 pounds of inerts per 1,000 pounds of catalyst circulated.

Because the prior art spent catalyst stripper is a dense bed system and the unit hydraulics require it to operate in the 25—25 pounds per cubic foot density range so that the unit will circulate properly, it is practically impossible to make this system into a true stripper as long as it is part of the reactor vessel. If enough stripping steam were added to the stripping section to achieve good countercurrent steam to catalyst flow for stripping, the entrainment of spent catalyst back into the reactor vessel will increase and the unit will be limited on circulation capabilities as the density decreases. The re-entrainment of spent catalyst into the reactor system could result in undesirable reactions and products.

With the increased use of catalytic cracking, as well as the treating and upgrading of residual oil feedstocks and with the advent of ultra-short contact time catalytic cracking as described in my U.S. Pat. No. 4,985,136, issued Jan. 15, 1991, entitled "ULTRA-SHORT CONTACT TIME FLUIDIZED CATALYTIC CRACKING PROCESS"; the fluidized process described in my U.S. Pat. No. 4,859,315, issued Aug. 22, 1989, entitled "LIQUID-SOLID SEPARATION PROCESS AND APPARATUS"; and my U.S. Pat. No. 4,263,128, issued Apr. 21, 1981, and entitled "UPGRADING PETROLEUM AND RESIDUAL FRACTIONS THEREOF", the need for improvement in circulating fluidized solids stripper design has become apparent to me. All of the above-identified patents are incorporated herein by reference in their entireties.

I have determined that operating such fluidized catalyst or fluidized solid systems on heavy residual oil requires a better stripping design in order to reduce the hydrocarbon carryover into the regenerator, which will reduce the regenerator temperature and reduce the need for catalyst cooling. Further, improved stripping will also reduce the $SO_x$ emissions from the regenerator. Still further, reducing the amount of catalyst cooling in the FCC process will reduce the coke yield. Also, the ultra-short contact time catalytic cracking process, known in the industry as the "Milli-Second Catalytic Cracking Process" or "MSCC Process" increases the catalyst to oil ratio by a factor of 2.5 to 3. For example, if one were to use the normal stripper design criteria for a spent catalyst stripper, the stripping vessel would be bigger in diameter and longer, and there would be a 2.5 to 3 fold increase in the stripping steam rate.

Therefore, a primary object of the present invention is to greatly reduce, by use of an improved dilute phase elongated riser stripping section fluidized with a lift vapor such as water and/or steam (hereinafter referred to as stripping medium or stripping media), the amount of hydrocarbons entrained with the spent catalyst or other solid into the regeneration system. More specifically, there is a significant reduction in the amount of hydrocarbons and/or coke containing sulfur compounds which otherwise passes into the regeneration system, while at the same time providing catalyst cooling. This will reduce the FCC regenerator temperature and increase the catalyst to oil ratio to give a more selective reaction.

In one embodiment of the present invention, the use of regenerator catalyst/solids coolers can be eliminated by use of this unique process wherein water or water mixed with steam would be used as the lift media. The vaporization of the water will cool the spent catalyst/solid as well as the regenerated catalyst/solid so that the regenerator catalyst/solid coolers are not necessary.

Yet, another object of the present invention is to reduce the $SO_x$ (sulfur oxides) emissions from the regenerator by converting more of the sulfur compounds on the spent catalyst to $H_2S$ by increasing the partial pressure of the water vapor in the stripper above that in conventional FCC strippers. This is more effective when the spent catalyst (or other solid) temperature is increased above 1000° F. by recycle of hot regenerated solid or catalyst. It is commonly accepted that the sulfur in the coke and hydrocarbons that are burned in the regenerator will combine with a metal oxide to produce a metal sulphate that will be reduced and liberated as $H_2S$ in the reactor in the presence of water vapor. The existing stripper limitations allow more material containing sulfur to enter the regenerator and reduce the amount of steam that can be used for stripping, which limits the partial pressure in the stripping section to push this reaction to completion. The present invention removes these limitations, with a resultant decrease in $SO_x$ in the regenerator flue gas emitted to the atmosphere because in the present invention there is used a dilute phase stripper whose effluent is maintained separate from the effluents of both the reactor and the regenerator.

Another object of the present invention is to separate the reactor and regenerator hydraulics in such fluidized systems so that the spent catalyst/solids stripper no longer has to be part of the reactor vessel, and therefore, the elevation of the reactor vessel can be lowered.

A further object of the present invention is to enable the use in such fluidized systems of higher stripping steam rates, which would not be possible in a dense bed stripper, and, also to permit recovery of more liquid and gas products as a result of improved stripping.

An additional object of the present invention is to enable reduction of the energy requirements for such fluidized systems as a result of the recycle and heat exchange of the stripping vapors.

Still another object of the present invention is to enable reduction of the catalyst losses from the regenerator of such fluidized systems by removing fines (solids of undesirably small particle size) from the circulating spent solid before they enter the regenerator.

SUMMARY OF THE INVENTION

To achieve the objects and in accordance with the purposes of the present invention, there is provided a novel fluidized solid process for circulating and stripping spent solid in a dilute phase, which process comprises contacting a hydrocarbon feedstock with a fluidized particulate solid in a contacting zone wherein carbonaceous deposits accumulate on the solid and the solid becomes spent and the resulting spent solid is passed to a regeneration zone wherein said deposits are removed from the spent solid by firing to form a regenerated particulate solid, the improvement comprising:

(a) removing a stream of the spent solid and entrained hydrocarbons from the contacting zone;

(b) removing a stream of hot regenerated solid from said regeneration zone;

(c) introducing the spent solid/entrained hydrocarbon stream and said hot regenerated solid stream into a lower portion of an elongated dilute phase stripping zone;

(d) introducing a stream of a fluid stripping medium into the lower portion of the stripping zone to contact the spent solid therein;

(e) passing a stream of the spent solid mixed with the hydrocarbons, the hot regenerated solid and the stripping medium upwardly in the stripping zone under dilute phase stripping conditions to an upper portion thereof;

(f) separating the spent and regenerated solid from the hydrocarbons and stripping medium in a separation zone connected to the upper portion of the stripping zone to produce separated solid substantially free of hydrocarbons;

(g) passing a fluidized stream of the separated solid substantially free of hydrocarbons from the separation zone to the regeneration zone;

(h) removing a stream containing vaporized separated hydrocarbons and stripping medium from the separation zone;

(i) separating the vaporized separated hydrocarbons from the stripping medium; and (j) recycling the separated stripping medium to the stripping zone.

The stripping medium is preferably a fluid selected from the group consisting of steam, water, sour water and mixtures thereof.

In one embodiment the process of the present invention is a fluidized catalytic cracking process and the particulate solid is a fluidizable cracking catalyst.

BRIEF DESCRIPTION OF THE DRAWING

The present invention will be described with reference to the accompanying drawing, wherein.

DESCRIPTION OF THE PREFERRED EMBODIMENTS

Figure 1:
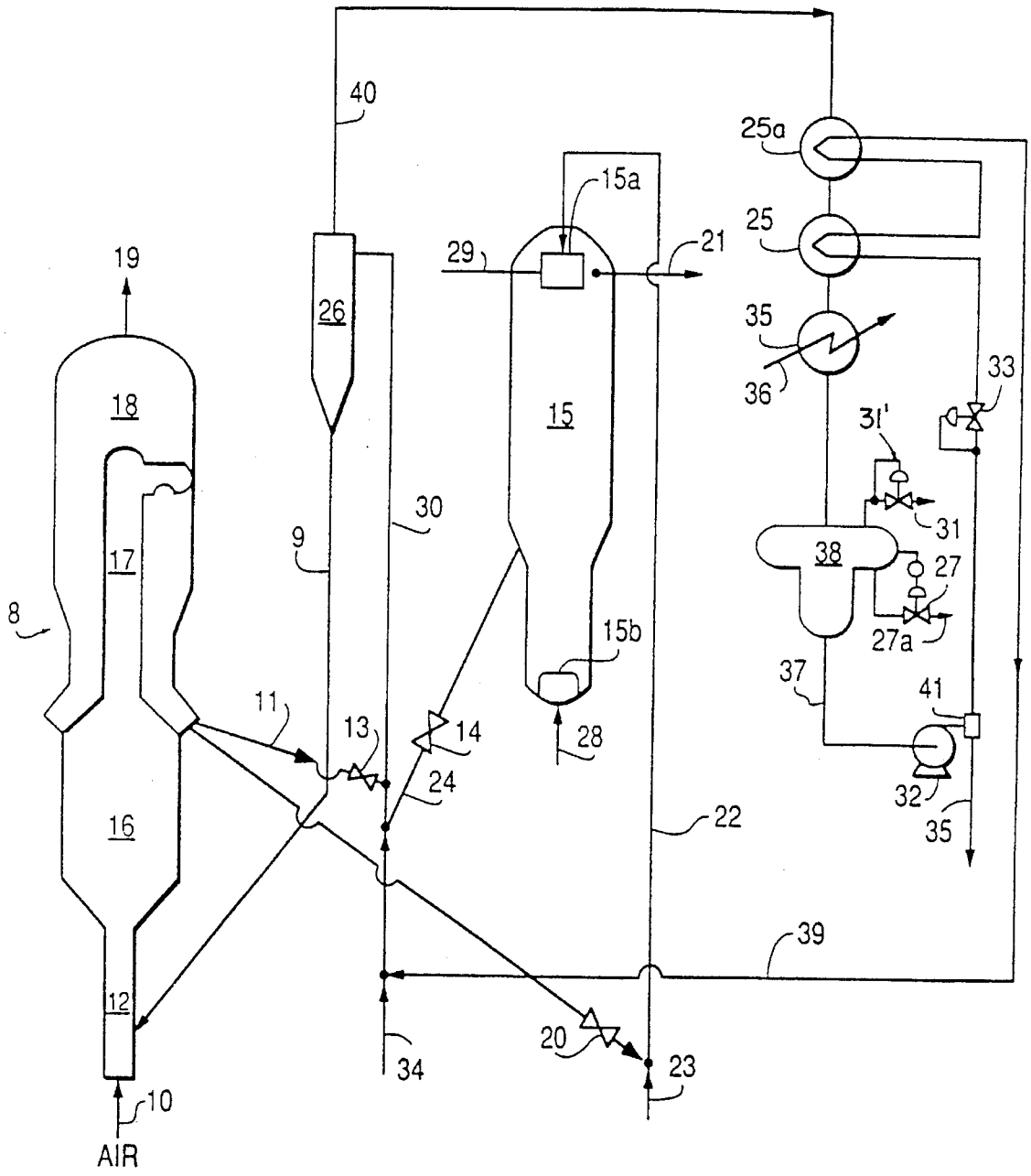
FIG. 1 is a schematic process flow diagram illustrating a preferred system for practice of the present invention in an FCC process.

The regenerator structure that is depicted in FIG. 1 is commonly referred to as the "UOP high efficiency" design and is described in U.S. Pat. Nos. 3,893,812 and 3,926,778, which are incorporated herein by reference in their entireties. The reactor is depicted in FIG. 1 as employing an MSCC contact system. However, any type of reactor and regenerator structure used in fluidized solids process systems may be used with the present invention, for example. The invention will be described hereinbelow with reference to the well-known FCC process, but it is also applicable to other fluidized processes for the treating, upgrading, etc. of hydrocarbon feedstock using a particulate solid material.

Referring to FIG. 1, combustion air is introduced through line 10 into the bottom of a regenerator mix chamber 12 together with separated spent catalyst from one or more cyclones 26, the total flow of which is regulated by spent catalyst slide valve 14 on reactor 15 level control, and with regenerated catalyst, the flow of which is regulated on flow control to maintain the temperature in dilute phase stripper 30 at greater than 1000° F., and preferably greater than 1100° F., through slide valve 13 in line 11. The catalyst passed via the cyclone dipleg 9 from cyclone 26 into mix chamber 12 is fluidized upwardly with the combustion air through the lower combustor 16, combustor riser 17, and into the bottom portion of the upper combustion chamber 18 of regenerator 8 wherein carbonaceous deposits on the spent catalyst are burned therefrom to produce regenerated catalyst and flue Was. The upper combustion chamber 18 normally contains two-stage cyclones to separate the regenerated catalyst from the flue gas which exits via line 19. The regenerated catalyst settles into the bottom of the upper combustor 18 where it will be recirculated to stripper 30 through slide valve 13 as described above or through regenerated catalyst slide valve 20 on reactor vapor outlet 21 temperature control into the bottom of regenerated catalyst riser 22. In the bottom of riser 22, the regenerated catalyst and entrained inerts from the regenerator are mixed with a lift/accelerating media, such as steam, water, hydrocarbon (gas or liquid) or the like, as described in my U.S. Pat. No. 5,332,704, which is incorporated herein by reference. The lift/accelerating media is introduced into riser 22 through line 23. This lift media accelerates the regenerated catalyst downwardly into MSCC contactor 15*a*, which is located in the top portion of reactor 15, where the downwardly flowing dispersed regenerated catalyst and the hydrocarbon feedstock introduced horizontally through line 29 are mixed together as described in my U.S. Pat. No. 4,985,136. The weight ratio of the regenerated catalyst to hydrocarbon feedstock in the contactor 15*a* is preferably greater than 10, most preferably from about 10 to about 25,weight parts of catalyst per weight part of hydrocarbon. The reactor vapors exit the reactor through line 21 after separation from the spent catalyst. The spent catalyst flows downwardly into the bottom of reactor 15, where it is fluidized and may be partially stripped by displacement in section 15*b* of entrained hydrocarbon vapors with a fluidizing medium, preferably steam or sour water injected through line 28. The spent catalyst and entrained hydrocarbon vapors then flow downwardly through spent catalyst standpipe 24 and then through spent catalyst slide valve 14 to the bottom of the dilute phase stripper 30. The spent catalyst is mixed therein with hot regenerated catalyst supplied from line 11 and slide valve 13 and with a well dispersed stripping media injected through lines 34 and 39. If desired, the hot regenerated catalyst may also be mixed with spent catalyst (or other hot solid) in the lower portion of reactor 15 and the mixture introduced into the lower portion of stripper 30.

For hydraulic reasons and in order to maintain a fluidized solids seal above slide valve 14 and to provide an inventory for process control considerations, FIG. 1 depicts an enlarged section 15*b* in the bottom of reactor 15; however, this section can be much shorter than that used in typical FCC process reactor designs, although it is necessary to provide process stability. This shorter section would allow the reactor vessel to be at a lower elevation than shown in FIG. 1.

With the use of the present invention it is possible to eliminate the need for dense phase stripping in section 15*b* of reactor 15, in which case all of the required stripping of the spent catalyst can be conducted in the riser stripper 30. As noted above, the bottom of reactor 15 only needs to have enough volume for inventory (stability) and to supply head for hydraulics. Therefore, with the use of only dilute phase stripping, the only steam and/or water required to be introduced into the bottom of reactor 15 is that amount required to maintain fluidization of the spent catalyst therein, and section 15*b* is used only as a fluidization section (i.e., no stripping decks or trays are used therein). In one preferred embodiment of this invention, using a gas oil feedstock, which requires minimal stripping media is steam which is generated and superheated in exchangers 25*a* and 25 as described hereinbelow. In another preferred embodiment of this invention using a residual oil feedstock either in an FCC, MSCC, 3D or ART type of process, which requires increased catalyst cooling, the stripping/cooling medium should be either water or a mixture of water and steam.

In any case, the resulting mixture of catalyst and stripping media then flows upwardly through stripper 30 into the first stage of cyclone separators 26 wherein the catalyst is separated from the hydrocarbons and stripping media. Only one cyclone separator is shown, but in a preferred embodiment there would be two stages of cyclone separation. The spent catalyst essentially free of hydrocarbon vapors is separated in cyclone 26 and flows downwardly through dipleg 9. A majority of the catalyst fines that otherwise, in a conventional FCC process system, would have exited the regenerator cyclones with the flue gas exiting through line 19, along with the majority of the entrained hydrocarbon vapors, instead exits cyclone 26 and flows via line 40 into heat exchanger 25*a* which acts to desuperheat the cyclone vapors and superheat the lift and stripping media flowing in line 39. The desuperheated vapors from exchanger 25*a* enter exchanger 25 wherein the vapors are condensed into water and liquid hydrocarbon product and a light gas product. The water/hydrocarbon/gas mixture from exchanger 25 enters exchanger 35 where the mixture is cooled to about 100° F. with cooling water from line 36. The resultant cooled mixture along with catalyst fines enters receiver 38 where the catalyst fines and water are separated together and exit from the bottom of receiver 38 through line 37. The hydrocarbon liquid exits receiver 38 on level control 27 through line 27*a* and passes to product recovery. The hydrocarbon gases exit the top of receiver 38 on differential pressure control 31' between the regenerator 18 and receiver 38 through line 31 and pass to product recovery. The water and catalyst fines exit the bottom of receiver 38 through line 37 and pump 32 which adds additional head to the water so that it can flow first through a catalyst/water separating device 41, such as hydroclones, and on flow control 33 through heat exchanger 25 wherein it is heated to become steam and heat exchanger 25*a* where the steam is heated further to become superheated steam before entering the stripper 30 through line 39. The separated catalyst fines are sent via line 35 to disposal or back to the reactor or regenerator vessels. Makeup stripping steam media can be added continuously along with recycle water from receiver 38 or superheated steam from exchanger 25*a* through line 34 entering at the bottom of the stripper; however, makeup stripping media can also be added at any point in the circuit.

In this process, the selection of the cooling, lift and stripping media will typically be between steam or water. For operations where the regenerated catalyst temperature is above 1350° F. water is the preferred lift media (although steam may be used), while between 1350° F. and 1230° F., a water-steam mixture is preferred over steam, and where the regenerated catalyst temperature below 1230° F., steam is preferred. The present invention permits a reduction of the energy requirements by recycle and exchange of the stripping vapors. This feature allows for the use of a mixture of water and steam as the lift medium in the dilute phase stripper so that the amount of catalyst cooling can be precisely controlled.

By using steam as the lift and stripping media and recovering the heat in the vapors in line 40 by superheating the steam to within 50 to 100° F. of the spent catalyst temperature in line 24, the coke yield increase required to heat this media to operating conditions will be greatly reduced compared to utilizing a saturated steam as stripping media.

As an example, in a typical dense phase stripper design, the upward steam velocity is less than 2 fps and the density in the stripper is between 25 and 35 pounds per cubic foot and the spent catalyst has a residence time of 1 to 3 minutes. In the present invention, the preferred density in the dilute phase stripper is greater than 0.1 pounds per cubic foot and less than 15 pounds per cubic foot with superficial velocities greater than 10 fps but less than 80 feet per second and steam residence times of less than 10 seconds. Note that in the dense phase stripper design, the residence time is on catalyst time since there is very little if any steam that is not entrained with the spent catalyst leaving the stripper. The design upward superficial velocities used in the present invention are very critical and the design upward superficial velocities relative to the diameter of the dilute phase stripper vessel are critical. That is the design velocities are chose to give a large internal catalyst reflux, where catalyst internal reflux is defined as the upward catalyst velocity relative to the upward steam vapor velocity. Stated another way, it is the theoretical catalyst density in the dilute phase stripper relative to the actual catalyst density in the dilute phase stripper. On this basis, for the dilute phase stripper to operate properly the actual catalyst density in the dilute phase stripper as measured by pressure differential across the dilute phase stripper bed must be at least 2 times the theoretical density. This means that the catalyst is traveling through the dilute phase stripper at no more than half the velocity of stripping vapors. Therefore, by proper design of the dilute phase stripper the internal catalyst reflux, which results from entrainment of the relatively dense phase of catalyst along the dilute phase stripper wall into the more turbulent center of the dilute phase stripper, produces the turbulence necessary to strip the hydrocarbons from the pore of the spent circulating solid. It should be noted that as the diameter of the dilute phase stripper becomes larger, the amount of internal catalyst reflux will increase at the same superficial vapor upward velocity because the laminar flow regime at the wall will increase. Stated another way, the design superficial velocity can be increased as the diameter of the dilute phase stripper increases to maintain the actual dense phase catalyst density at greater than 2 times the theoretical density, which is the overriding design criteria along with at least one second of steam vapor residence time. This will reduce the amount of entrained sulfur compounds such as H2S and RSH and result in less sulfur compounds being fed into the regenerator where they would be combusted to SOx. Because of the quantity of stripping steam vapors (up to or more than 25 times greater relative to the spent catalyst than in the dense phase stripper) and the fact that these vapors are continually removing the entrained hydrocarbons and are flowing at an upward superficial velocity at least twice as fast as the spent solid, the steam vapor partial pressure is much higher than in the typical dense phase stripper. This results in a shift of the metal sulfide and water vapor reaction to completion with the resultant production of H2S which is removed from the spent solid in the dilute phase stripper and thereby reduces the regenerator flue gas SOx content.

In one embodiment of the present invention, as shown in FIG. 1, the process comprises using the dilute phase system steam effluent as water recycle to reduce or eliminate the need for catalyst coolers in the regenerator. Up until this time, catalyst coolers have always been installed in the regenerator as coils in the regenerator dense bed or as separate exchangers, or in the case of processes of the type described, e.g., in U.S. Pat. No. 4,917,790, in the dense phase of a reactor second stage stripper. These systems have been plagued with operating problems caused by erosion and thermal expansion. The use of the present invention reduces the design temperature from the 1600° F. range to less than 1200° F. and permits the elimination of the exchanger from the dense bed/fluidized solids environment, which should greatly reduce the mechanical failure rate and increase the mechanical reliability and on-stream factor for this type of process. Also the present invention greatly reduces the time that regenerated catalyst is in contact with steam since it takes place in a dilute phase riser at less than 1200° F. and not in a dense bed as in the aforementioned patent. Since the catalyst retention time in the bottom of contactor 15 is minimal because it is not used as a dense bed stripping section in this invention, the hot regenerated catalyst from valve 13 may be added either to the bottom of reactor 15 or as shown in the bottom of stripper 30.

If it is desired to use water as the stripping media instead of steam so that one can eliminate or reduce the need for regenerated catalyst coolers, the only changes necessary in the above-described design is to bypass exchangers 25 and **25*a* with the condensed water from receiver 38 and pump 31 and pass the water directly to the stripper 30 through line 39 utilizing flow control 33. The cooling media used in exchanger 25 can then be boiler feed water which will become steam in exchanger 25 and be superheated in exchanger 25*a* before it is added to the refinery steam system. Other cooling media could be used in exchangers 15*a* and 25**, but boiler feed water and steam are the preferred media.

As discussed earlier, the use of the conventional dense phase stripper design with stripping trays limits the amount of steam that can be used for stripping to typically less than 3 to 4 pounds per 1000 pounds of catalyst circulated. If one exceeds this rate, the spent catalyst entrainment back into the reactor increases which can result in less selective reactions, the dense bed stripper becomes dilute phase and catalyst circulation is lost, and the increased stripping steam rate increases the load on the downstream fractionation section resulting in higher pressures in the reactor system and reduces the downstream capacity to handle hydrocarbons.

In one embodiment of the present invention, as shown in FIG. 1, the process comprises mixing spent catalyst from the reactor 15 and hot regenerated catalyst from the upper combustor chamber 18 of regenerator 8 with a liquid or vapor media in the lower portion of a lift pipe or stripper 30. The spent catalyst and hot regenerated catalyst, whose individual flows are regulated by flow control valves into the stripper, which is preferably vertical to minimize the differential pressure across the stripper, mixes with a media, such as steam, water, or sour water from the downstream fractionation system, to act both as a fluidizing lift media for the spent catalyst and stripping media to strip the entrained hydrocarbons from the spent catalyst. The quantity of this lift and stripping media used is that needed to maintain dilute phase stripping conditions in the lift pipe, or stripper. For the purposes thereof, the term "dilute phase stripping conditions" means that the density of the catalyst/hydrocarbons/stripping media mixture in the stripper is from about 0.1 up to at about 15, preferably between about 3.0 and about 15, pounds per $ft^3$, the superficial upward velocity thereof is less than 120, preferably between about 10 and about 80, fps (feet per second), and the temperature thereof is at least 1000° F. At the top of the lift pipe, the spent and regenerated catalyst and vapors enter directly into one or two stages of cyclone separation 26 to separate substantially all, e.g., at least 99%, of the circulating catalyst from the lift media vapors. The separated catalyst, which is free of most of the fines, flows down the cyclone dipleg 9 from which the catalyst can either be collected in a catalyst surge vessel or flow directly into the regenerator.

The separated catalyst exiting the bottom of the cyclone separator is now of improved quality. It is essentially free of catalyst fines and hydrocarbon vapors which contain sulfur compounds.

The vapors, which contain sulfur compounds, and the catalyst fines separated from the catalyst in the cyclone separator(s) 26 exit the cyclone and can be vented off to product recovery, or in a preferred mode, condensed in a series of exchangers to produce a hydrocarbon liquid, water and gas product. In the latter case, the hydrocarbon liquid product can be further processed in the main fractionator, the water recycled back to the bottom of the lift line as lift media or vaporized by exchange with the cyclone vapors and used as a vapor lift media. The gas product can be vented off on pressure control to recovery in a gas concentration unit (not shown).

Unlike the prior art, the present invention isolates the dilute phase stripper effluent from the reactor or regenerator effluent and processes them separately. This allows for the optimization of the conditions for sulfur removal from the spent catalyst coke and hydrocarbons trapped in the pores of the catalyst while at the same time providing catalyst cooling and not overloading the reactor vapor downstream fractionation and gas concentration system.

An example of the present invention will now be described with reference to FIG. 1. In a 25,280 BPD MSCC unit operating at 35 psi in both the reactor 15 and regenerator 18, circulating 70.9 tons per minute (T/M) of regenerated catalyst, the stripper 30 would be about 4 feet in diameter and require about 160,000 pounds per hour of stripping steam. This stripping steam rate is about 50 weight % of the feed rate or about 250 mole % of the reactor vapors. This stripping steam rate equates to 18.8 pounds of steam per 1000 pounds of catalyst circulation as compared to the 3 pounds or less used in conventional state of the art dense phase strippers.

The amount of hydrocarbons entrained with the spent catalyst into the stripper is estimated to be about 6,500–10,000 pounds per hour, or about 2–3 weight % of the hydrocarbon feedstock. The stripping and recovery of these hydrocarbons from the spent catalyst will increase the light ends yield by 2–3 weight %.

The 70.9 T/M of 980° F. spent catalyst and 6,500–10,000 #/hr of entrained hydrocarbons flows through slide valve 14 into stripper 30 where it is contacted with 160,000 #/hr of superheated lift steam from line 39 and as much as 70.9 tons per minute of regenerated catalyst. The resultant mixture at about 1130° F. and 70 feet per second (fps) is transported up the dilute phase stripper 30 to cyclone 26 where a catalyst stream comprising 99%+ of the total catalyst with entrained steam plus less than 6% of the original entrained hydrocarbons is separated from a vapor stream which consists of the stripping media, hydrocarbons vapors, $H_2S$ and catalyst fines. The separated stripped catalyst stream, essentially free of hydrocarbon vapors and greater than 50 weight of the original sulfur compounds, flows downwardly through dipleg 9 into the regenerator mix chamber 12.

The hot catalyst is mixed with air from line 10 and flows upwardly through lower combustor 16, combustor riser 17 and into upper combustor 18 where the regenerated catalyst and flue gas exiting through line 19 are separated. The flue gas contains less catalyst fines because of the pre-separation in cyclone 26. Some of the regenerated catalyst flows through slide valve 13 to control stripper 30 at the desired temperature and more regenerated catalyst flows downwardly through regenerated catalyst standpipe and slide valve 20 to mix with well dispersed lift/acceleration media introduced through line 23 at the base of regenerated catalyst riser 22. The regenerated catalyst lift/acceleration media lifts and accelerates the regenerated catalyst up riser 22 to the top of reactor 15 where it combines with fresh hydrocarbon feedstock charged through line 29 into an MSCC contact system **15*a*. After passing through the MSCC reactor the spent catalyst and reactor vapors are then separated. The reactor vapors exit the reactor through line 21 for downstream processing, while the spent catalyst flows downwardly to the bottom of reactor 15 where the spent catalyst is kept fluidized and partially stripped with water or steam injected through line 28. The spent catalyst flows down spent catalyst standpipe 24 to slide valve 14** to complete the circuit.

Cyclone 26 vapors at about 1130° F. enter exchanger **25*a* to be desuperheated by exchange with steam. The desuperheated vapors enter exchanger 25 to be condensed by exchange with condensed water from receiver 38 to produce steam. The condensed water and hydrocarbon liquid and gas from exchanger 25 enter exchanger 35 to be cooled by cooling water supplied through line 36 to about 100° F. The cooled condensate with the catalyst fines, hydrocarbon liquid and hydrocarbon gas flows into receiver 38 where the water and catalyst are separated from the hydrocarbons. The hydrocarbon gases with some water vapor exit receiver 38 on differential pressure control between the regenerator 18 and receiver 38. The condensed water (condensate) plus catalyst fines are pumped by pump 32 into hydroclones 41 to separate the water and 99%+ of the catalyst fines. The catalyst fines plus entrained water from hydroclones 41 are sent to disposal or back to the circulating inventory. The condensate essentially free of catalyst fines flows through flow control 33 to exchanger 25 where it is vaporized to steam. The steam flows to exchanger 25*a* where it is superheated before it is injected into the bottom of stripper 30 through line 39** to complete the circuit.

In one embodiment of the present invention that would require catalyst/solids cooling, the 70.9 T/M regenerated solids at 1500° F. mixed with 70.9 T/M of 980° F. spent solid would result in a mix temperature of 1240° F. instead of 1130° F. If the 160,000 #/hr of lift steam where replaced with 160,000 #/hr of lift water, this mixture would be cooled about 85 degrees to 1155° F. at the outlet of cyclone 26. This lift water that is changed into steam in stripper 30 can then be condensed and cooled in exchangers 25, 35 and **25*a* and recycled back to stripper 30** as lift water to repeat the cycle and act as a catalyst/solid coolant.

Additional stripping media can be added through line 34 to make up for the stripping media entrained with the catalyst from cyclone 26, lost with the hydrocarbons from receiver 38 and lost with the catalyst fines from hydroclones 41. Line 34 is shown as one line but it can be as many lines as desired for different lift media as discussed above, so that more than one lift media could be used at a time (i.e., steam, water or sour water).

Having described preferred embodiments of the present invention, it is to be understood that variations and modifications thereof falling within the spirit of the invention may become apparent to those skilled in this art, and the scope of the present invention shall be determined by the appended claims and their equivalents.

What is claimed is:

1. In a fluidized process which process comprises contacting a hydrocarbon feedstock with a fluidized particulate solid in a contacting zone wherein carbonaceous deposits accumulate on the solid and the solid becomes spent and the resulting spent solid is passed to a regeneration zone wherein said deposits are removed from the spent solid by firing to form a regenerated particulate solid, the improvement comprising:

(a) removing a stream of the spent solid and entrained hydrocarbons from the contacting zone;

(b) removing a stream of hot regenerated solid from said regeneration zone;

(c) introducing the spent solid/entrained hydrocarbon stream and said hot regenerated solid stream into a lower portion of an elongated dilute phase stripping zone;

(d) introducing a stream of a fluid stripping medium into the lower portion of the stripping zone to contact the resulting mixture of spent solid and regenerated solid therein;

(e) passing a stream of the spent solid/entrained hydrocarbon mixed with the hot regenerated solid and stripping medium upwardly in the stripping zone under dilute phase stripping conditions to an upper portion thereof;

(f) separating substantially all of the spent solid and regenerated solid from the hydrocarbons and stripping medium in a separation zone connected to the upper portion of the stripping zone to produce separated solids substantially free of hydrocarbons;

(g) passing a fluidized stream of the separated solids substantially free of hydrocarbons from the separation zone to the regeneration zone;

(h) removing a stream containing vaporized separated hydrocarbons and stripping medium from the separation zone;

(i) separating the vaporized separated hydrocarbons from the stripping medium; and (j) recycling the separated stripping medium to the stripping zone.

2. The process of claim 1, wherein said process is a fluidized catalytic cracking process and said particulate solid is a fluidizable cracking catalyst.

3. The process of claim 1, wherein said stripping medium is a fluid selected from the group consisting of steam, water, sour water and mixtures thereof.

4. The process of claim 1, wherein said solid returned to said regeneration zone is substantially free of fines.

5. The process of claim 1, wherein said separation zone comprises one or more cyclone separators.

6. The process of claim 3, wherein said separated stripping medium is heat exchanged with boiler feed water to produce steam.

7. The process of claim 3, wherein said separated stripping medium is heat exchanged with condensed separated stripping medium to produce superheated stripping medium for recycle back to the lower portion of said contacting zone.

8. The process of claim 7, wherein said condensed stripping medium is treated to remove solid fines therefrom before being vaporized.

9. The process of claim 1, wherein said stripping medium is water and said water cools said spent solid to increase the solid to hydrocarbon ratio in said contacting zone.

10. The process of claim 1, wherein the residence time of said solid in said stripping zone is less than 10 seconds.

11. The process of claim 10, wherein said residence time is less than 4 seconds.

12. The process of claim 1, wherein the superficial velocity of said solid in said stripping zone is less than 120 fps.

13. The process of claim 1, wherein the density of the fluidized stream in said stripping zone is less than 15 pounds per cubic foot.

14. The process of claim 1, wherein said stripping zone is an elongated, vertical vessel.

15. The process of claim 2, wherein the weight ratio of the regenerated catalyst to hydrocarbon feedstock in said contacting zone is greater than 10 weight parts of catalyst per weight part of hydrocarbon.

16. The process of claim 2, wherein the temperature of the regenerated catalyst is less than 1350° F.

17. The process of claim 2, wherein the temperature of the regenerated catalyst is less than 1250° F.

18. The process of claim 1, wherein the temperature within said stripping zone is greater than 1000° F.

19. The process of claim 1, wherein said stream containing separated hydrocarbons and stripping medium removed from said separation zone contains at least 50 weight % of any sulfur compounds on said spent solid removed from said contacting zone.

20. The process of claim 3, wherein said stripping medium is introduced into said stripping zone at a rate greater than 3 pounds per 1,000 pounds of spent solid.

21. In a fluidized process which process comprises contacting a hydrocarbon feedstock with a fluidized particulate solid in a contacting zone wherein carbonaceous deposits accumulate on the solid and the solid becomes spent and the resulting spent solid is passed to a regeneration zone wherein said deposits are removed from the spent solid by combustion to form a hot regenerated particulate solid, the improvement comprising:

(a) removing a stream of the spent solid from the contacting zone;

(b) removing a stream of hot regenerated solid from said regeneration zone;

(c) introducing the spent solid and hot regenerated solid streams into a lower portion of a vertical elongated dilute phase stripping zone;

(d) introducing a stream of a fluid cooling medium into the lower portion of the elongated dilute phase zone to contact and cool the resulting mixture of spent solid and hot regenerated solid therein;

(e) passing a stream of said resulting mixture of solids and cooling medium upwardly in the elongated dilute phase stripping zone to an upper portion thereof;

(f) separating substantially all of the spent and regenerated solids from the cooling medium in a separation zone connected to the upper portion of the dilute phase zone to produce a cooled solid;

(g) passing a fluidized stream of the cooled separated solid from the separation zone to the regeneration zone; and (h) removing a stream containing vaporized separated cooling medium from the separation zone.

22. The process of claim 21, wherein the cooling medium is water, steam or a mixture thereof.

23. The process of claim 22, wherein the vaporized medium is condensed and recycled to the dilute phase zone.

* * * * *